US006307946B1

(12) United States Patent
Fujimoto et al.

(10) Patent No.: US 6,307,946 B1
(45) Date of Patent: Oct. 23, 2001

(54) MINIATURE MICROPHONE COMPONENT

(75) Inventors: Mitsuhiro Fujimoto; Takako Okayasu, both of Aichi (JP)

(73) Assignee: Fuji Polymer Industries Co., Ltd., Aichi (JP)

( * ) Notice: Subject to any disclaimer, the term of this patent is extended or adjusted under 35 U.S.C. 154(b) by 0 days.

(21) Appl. No.: 09/085,500

(22) Filed: May 27, 1998

(30) Foreign Application Priority Data

Jun. 25, 1997 (JP) ..... 9-168259

(51) Int. Cl.[7] ..... H04R 25/00

(52) U.S. Cl. ..... 381/355; 381/361; 381/368; 439/86

(58) Field of Search ..... 381/355, 361, 381/365, 368, FOR 147, FOR 148; 379/431, 432, 433, 369; 439/86, 91

(56) References Cited

U.S. PATENT DOCUMENTS

| | | | |
|---|---|---|---|
| 3,816,671 | 6/1974 | Fraim et al. . | |
| 5,574,794 | 11/1996 | Valley . | |
| 5,613,011 | 3/1997 | Chase et al. . | |
| 5,788,516 | 8/1998 | Uggmark | 439/86 |
| 5,923,750 | 7/1999 | Enting et al. . | |
| 6,217,349 * | 4/2001 | Konno | 439/91 |

* cited by examiner

*Primary Examiner*—Huyen Le
(74) *Attorney, Agent, or Firm*—Merchant & Gould P.C.

(57) ABSTRACT

A miniature microphone component comprises a miniature microphone having a terminal area; a rubber casting for protection against vibration covering the circumference of the miniature microphone; and a rubber connector with anisotropic conductivity comprising an electrically conductive layer and an electrically isolating layer, which is clamped and retained so as to have areal contact with the terminal area of the miniature microphone. The miniature microphone, the rubber casting for protection against vibration covering the miniature microphone and the conductive rubber connector are integrated into one component. The rubber connector with anisotropic conductivity is shaped so that none of its electrically conductive layers has contact with more than one terminal of the miniature microphone at a time. The miniature microphone component can be installed simply by pressing it against a terminal portion on a circuit board in a small-size mobile communication device such as a mobile phone. The steps of soldering and wiring a lead wire can be omitted and the installation space can be minimized.

11 Claims, 5 Drawing Sheets

MINIATURE MICROPHONE COMPONENT

FIELD OF THE INVENTION

The present invention relates to a miniature microphone component that is optimized for insertion into the main body of a small-size communication device such as a mobile phone or a mobile radio.

BACKGROUND OF THE INVENTION

At present, the development of ever smaller and lighter small-size portable communication devices is well-stablished, and thus microphone elements to be used as components of such communication devices are also becoming smaller. For the installation of a miniature microphone in such a communication device, a thin lead wire is soldered to connect the terminals of the miniature-microphone-side to the terminals on a circuit board in the main body of the small-size communication device, and then the miniature microphone is covered with a rubber casting as a waterproof seal and inserted into the small-size communication device.

However, the process of attaching the miniature microphone by soldering with a thin lead wire leads to problems in that the product quality is not steady, because this process involves a delicate soldering job that has to be performed by hand and hardly can be automatized, and the installation space cannot be made narrower, since the lead wire has to be connected.

In order to overcome these problems of the prior art, it is a purpose of the present invention to provide a miniature microphone component with a rubber connector with anisotropic conductivity for an installation method wherein the soldering job is eliminated, thus facilitating the assembly, and the installation space can be made very small.

SUMMARY OF THE INVENTION

The miniature microphone component using a rubber connector with anisotropic conductivity according to the present invention, comprises a miniature microphone having a terminal area; a rubber casting for protection against vibration covering the circumference of the miniature microphone; and a rubber connector with anisotropic conductivity (called a "zebra-type rubber connector with anisotropic conductivity" in the following) comprising electrically conductive layers and electrically isolating layers, which is clamped and retained to have areal contact with the terminal area of the miniature microphone. The miniature microphone, the rubber casting for protection against vibration covering the miniature microphone and the conductive rubber connector with anisotropic conductivity are integrated into one component. According to this structure, the miniature microphone component of the present invention can be installed simply by pressing it against a terminal portion on a circuit board, and the steps of soldering and wiring a lead wire can be omitted. Furthermore, the installation space can be minimized.

It is preferable that the rubber connector with anisotropic conductivity is shaped so that none of its electrically conductive layers has contact with more than one terminal of the miniature microphone at a time. When an electrically conductive layer has contact with two or more terminals at the same time, it causes a short between those terminals, so that the miniature microphone cannot function correctly.

It is preferable that the rubber casting for protection against vibration is made of silicone rubber, because silicone rubber has high weather resistance and provides an excellent protection against vibration.

Possible materials to be used for the rubber members of the rubber connector with anisotropic conductivity include polybutadiene, natural rubber, polyisoprene, styrene-butadiene copolymer rubber (SBR), butadiene-acrylonitrile copolymer rubber (NBR), ethylene-propylene nonconjugated diene copolymer (EPDM), ethylene-propylene copolymer (EPM), polyurethane-polyester-based rubber, chloroprene rubber, epichlorohydrin rubber and silicone rubber. However, considering its electrical properties and weather resistance, silicone rubber is the most preferable.

It is preferable that the electrically conductive layers of the rubber connector with anisotropic conductivity comprise, per 100 weight parts of rubber component, 1–400 weight parts, more preferably 100–300 weight parts, of at least one electrically conductive powder selected from the group consisting of platinum, gold, silver, nickel, cobalt, copper, tin, aluminum and palladium metal powder; an alloy powder containing solder; a conductive powder of organic polymer powder that has been coated with a metal; and a conductive powder of inorganic powder that has been coated with a metal.

It is also preferable that the electrically conductive layers of the rubber connector with anisotropic conductivity comprise 10–150 weight parts carbon powder, more preferably 40–100 weight parts, per 100 weight parts rubber component. Good conductivity is not attained, when the added amount of electrically conductive powder or carbon powder is below these ranges. When the added amount of electrically conductive powder or carbon powder is above these ranges, the conductivity hardly increases, and the formability and the compression resilience of the rubber connector are inhibited.

It is preferable that the zebra-type rubber connector with anisotropic conductivity is elastically compressible and can be installed by area-contacting it with a terminal portion on a circuit board. When the rubber connector is elastically compressible, it can elastically deform in an appropriate manner to be compressed between a terminal of the miniature microphone and a terminal of the circuit board when the miniature microphone component is built into a small-size communication device. Thus, the rubber connector can establish secure areal contact between the two terminal areas. As a result, this increases the reliability of the electric connection. Furthermore, the miniature microphone is retained elastically against vibration by the rubber connector and the rubber casting, and its vibration resistance is increased.

It is preferable that the rubber members have a compression resilience of 30–80 measured with Method A in JIS K6301. If the compression resilience is below this range, the elastic deformation of the rubber connector becomes large, and the conductivity becomes pressure sensitive, so that the electric contact resistance to the terminals of the circuit board becomes unstable. If the compression resilience is above this range, the elastic deformation of the rubber connector becomes small, so that the reliability of the electric contact with the terminals of the circuit board decreases. Method A in JIS K6301 for measurement of the compression resilience is performed as follows: A sample piece of the size specified in JIS K6301 is prepared from the material to be tested. An A-type spring-based hardness meter according to JIS K6301 is used as the measuring instrument. Method A in JIS K6301 is in conformity with Type A in ASTM D2240.

The miniature microphone component according to the present invention can be used in various applications, but it is preferable that it is built into a small-size portable communication device such as a mobile phone. The miniature microphone component according to the present invention can be assembled without soldering a lead wire to it, so that the installation space can be minimized. The reliability of the electrical connection and the vibration resistance can be increased simultaneously, because the miniature microphone is clamped in and retained by the rubber connector and the rubber casting against vibration. This can add to the product value of small-size portable communication devices, for which an increase of miniaturization and reliability is especially desirable.

In a miniature microphone component using the above zebra-type rubber connector with anisotropic conductivity, a highly reliable electrical contact can be established just by slightly compressing the zebra-type rubber connector with anisotropic conductivity between the terminal area of the miniature microphone and the terminal area on the circuit board inside the small-size communication device. Moreover, the zebra-type rubber connector with anisotropic conductivity is conductive only in the thickness direction of the rubber connector. The zebra portion (i.e. the layered portion of alternating electrically conductive layers and electrically isolating layers) has anisotropic conductivity and is isolating in the layering direction. In addition, the zebra portion is shaped so that none of its electrically conductive layers has contact with more than one terminal of the miniature microphone at a time, which allows an electrical contact with high reliability and eliminates the need for troublesome positioning of the rubber connector. Moreover, since a plurality of circuit terminals can be connected by one rubber connector, soldering of a lead wire to establish contact with a circuit board becomes obsolete. Thus, not only can the installation space be made much smaller, but a troublesome installation job can be eliminated.

In addition, the rubber casting (bushing) for protection against vibration is shaped so that it can hermetically cover the entire miniature microphone except for the terminal area and a sound-collecting portion and at the same time clamp and fix the zebra-type rubber connector with anisotropic conductivity in areal contact with the terminal. Thus, it is possible to integrate the rubber casting with the miniature microphone and the rubber connector. As a result, the miniature microphone can be assembled just by inserting the miniature microphone component using a zebra-type rubber connector with anisotropic conductivity into a predetermined location inside the small-size communication device, which considerably increases the working efficiency of the assembly.

The use of the bushing as a protection against vibration enhances of course the reliability of the miniature microphone under vibration, and when the miniature microphone component is built into a small-size communication device, the pressure between the microphone terminal area and the circuit board terminal area is held constant due to the rubber resilience of the bushing. Thus, the additional effect of an electric contact with high reliability is achieved.

DESCRIPTION OF THE PREFERRED EMBODIMENTS

In the following, the present invention is described more specifically with examples. However, the present invention is by no means limited to these examples.

Figure 1A:
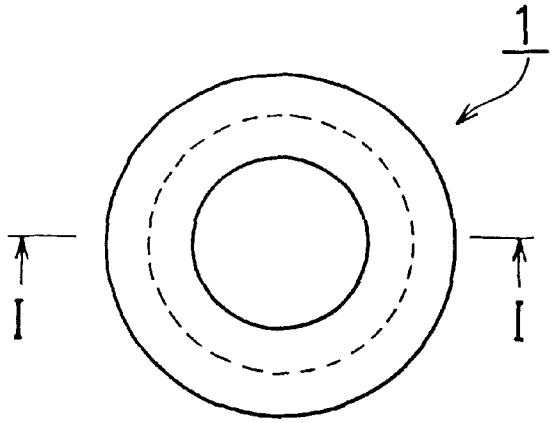
FIG. 1A shows a top view of a miniature microphone component according to a first example of the present invention.
Figure 1B:
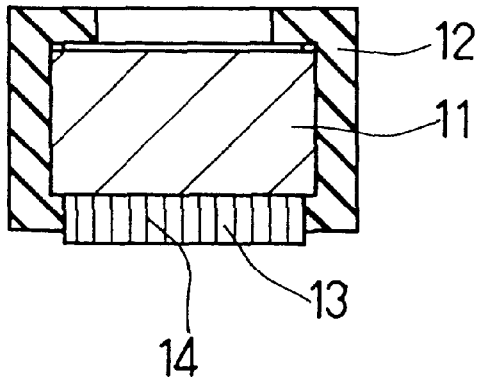
FIG. 1B shows a sectional view along line I—I in FIG. 1A seen in arrow direction.
Figure 1C:
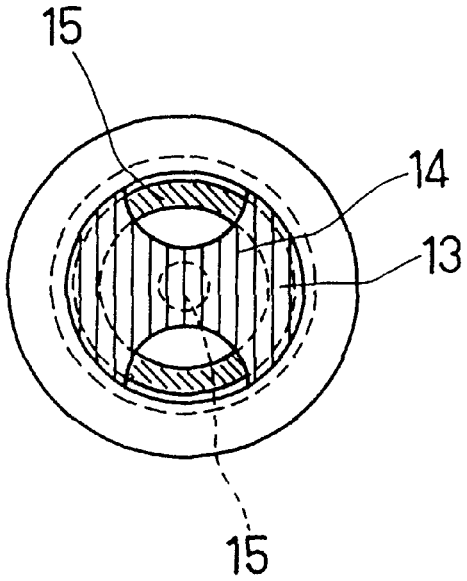
FIG. 1C shows a bottom view of the same example.

In a first example as shown in FIG. 1A (top view), FIG. 1B (sectional view along line I—I in FIG. 1A) and FIG. 1C (bottom view), a miniature microphone component 1 comprises a miniature condenser microphone 11, a zebra-type rubber connector with anisotropic conductivity 13 and a rubber casting 12 (also called a "bushing") for protection against vibration. The size of the miniature microphone component 1 is 6–10 mm in diameter and 2–5 mm in height. The thickness of the rubber casting 12 for protection against vibration is about 0.9 mm. The zebra-type rubber connector with anisotropic conductivity 13 has a thickness of about 1.0 mm.

As becomes clear from FIG. 1C (bottom view), the zebra-type rubber connector with anisotropic conductivity is processed to have a shape so that each one of the electrically conductive layers 14 of its zebra (i.e. striped) portion does not have contact with more than one terminal 15 at a time.

Figure 2:
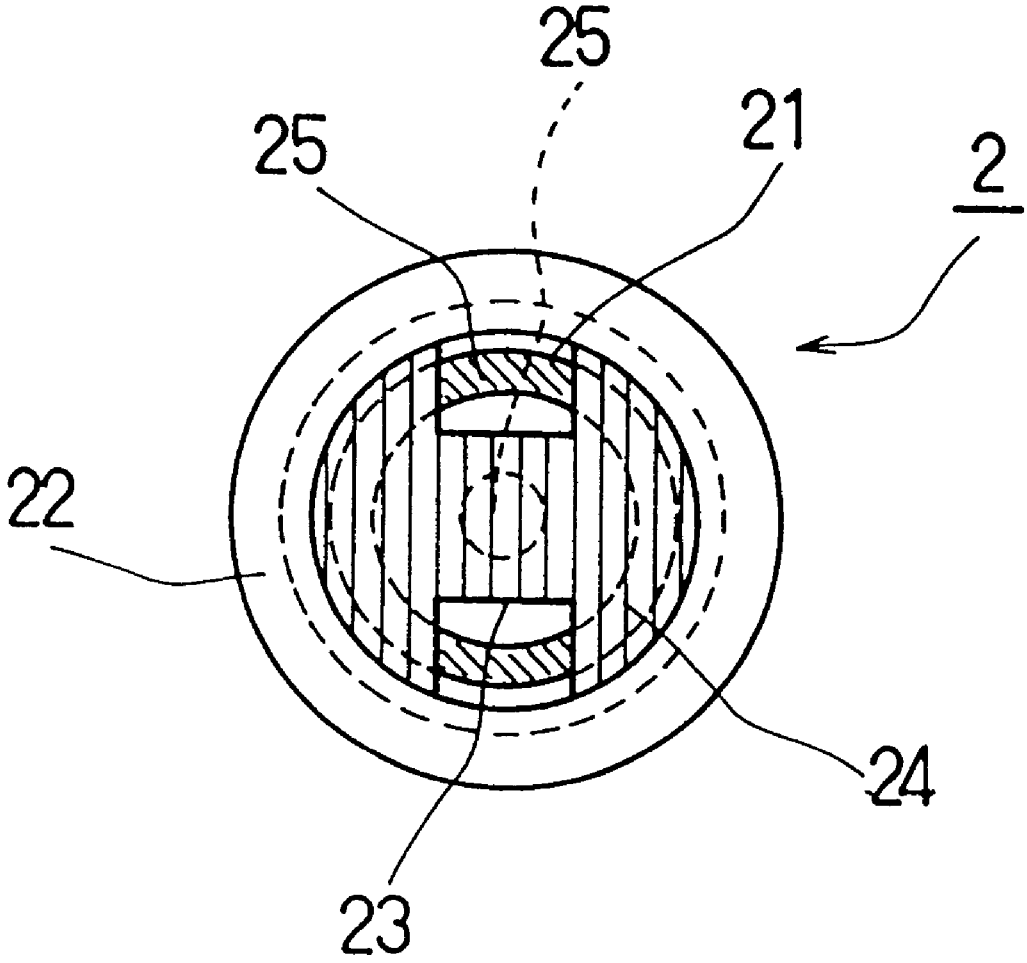
FIG. 2 shows a bottom view of a miniature microphone component according to another example of the present invention.
Figure 3:
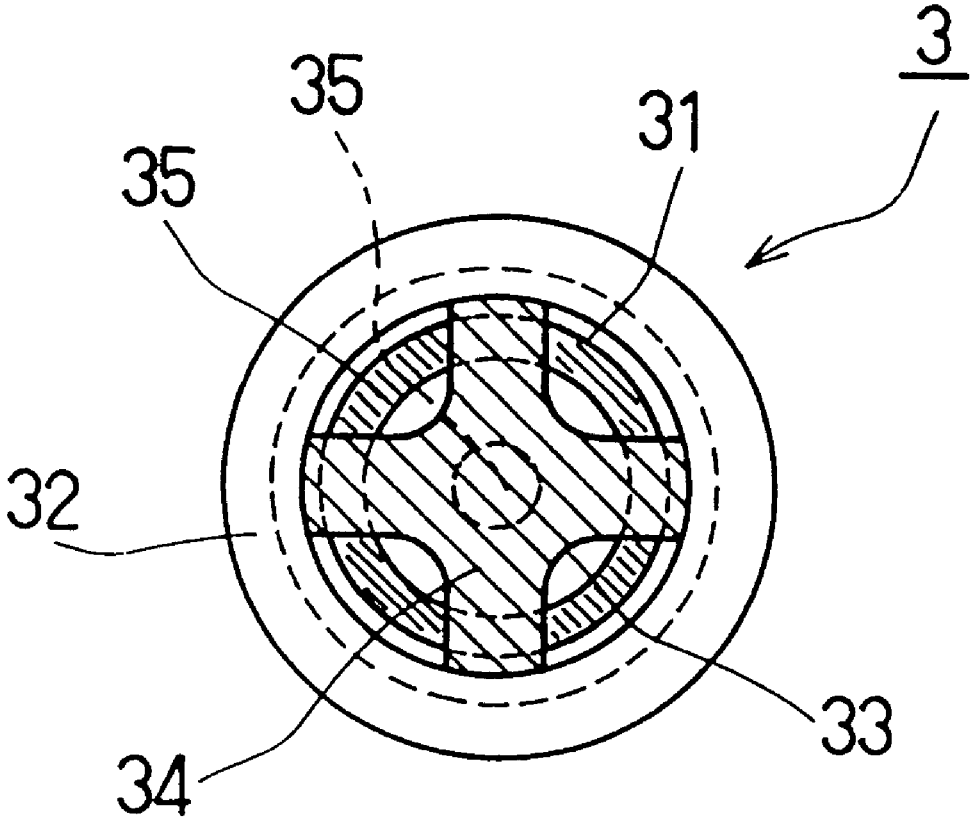
FIG. 3 shows a bottom view of a miniature microphone component according to another example of the present invention.
Figure 4:
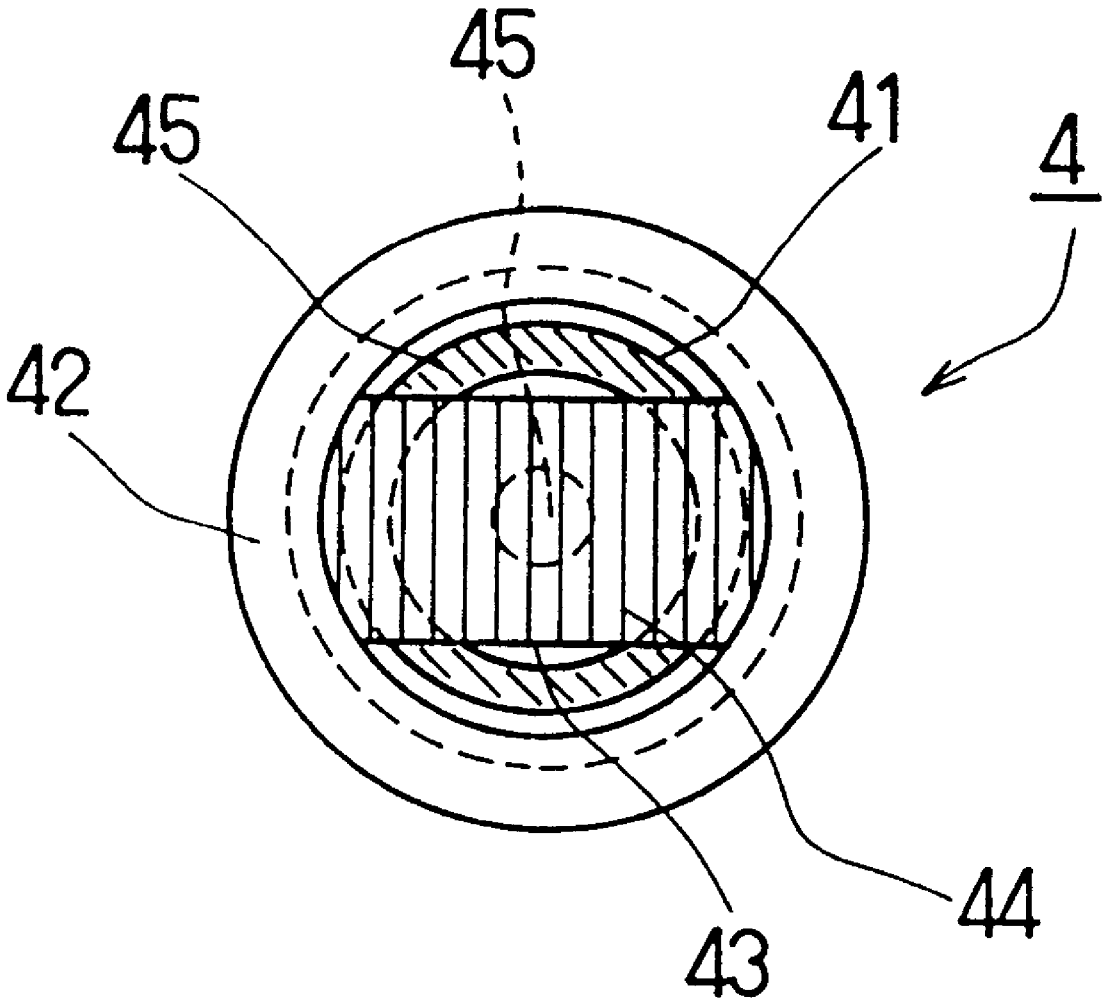
FIG. 4 shows a bottom view of a miniature microphone component according to another example of the present invention.

FIGS. 2, 3 and 4 are bottom views of other examples of the present invention. Each of the electrically conductive layers 24, 34 and 44 in the zebra portion of the zebra-type rubber connectors with anisotropic conductivity 23, 33 and 43 is shaped so that it does not have contact with more than one terminal 25, 35, or 45 respectively at a time. The numerals 2, 3 and 4 indicate miniature microphone components, numerals 21, 31 and 41 indicate miniature condenser microphones and numerals 22, 32 and 42 indicate rubber castings for protection against vibration.

Figure 5:
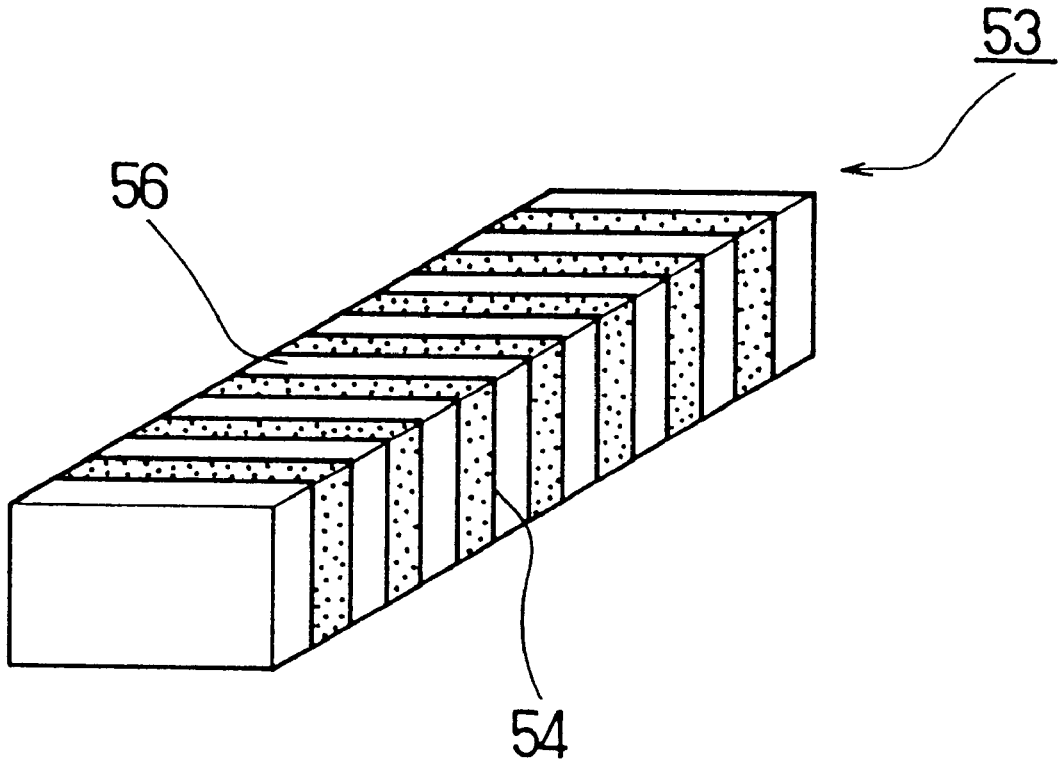
FIG. 5 shows a perspective view of an example of a zebra-type rubber connector with anisotropic conductivity according to the present invention.

FIG. 5 (perspective view) illustrates an example of the zebra-type rubber connector with anisotropic conductivity 53 comprising alternating electrically conductive layers 54 made of conductive silicone rubber and electrically isolating layers 56 made of isolating silicone rubber. To be specific, a zebra-type rubber connector with anisotropic conductivity of the "Fujipoly Connector Z-Series" (product of Fuji Polymer Ind., Co.) using conductive silicone rubber containing carbon powder for the conductive members, or a zebra-type rubber connector with anisotropic conductivity of the "Fujipoly Connector S-Z-Series" (product of Fuji Polymer Ind., Co.) using conductive silicone rubber containing metal powder for the conductive members can be used as the zebra-type rubber connector for this example. It is preferable that the zebra-type rubber connectors with anisotropic conductivity 13, 23, 33 and 43 have a thickness of about 1–2 mm layer thickness in layering direction of the zebra portion is about 0.05–0.50 mm.

A silicone rubber casting such as "Fuji Poly M Mould 4EC Bushing" (product of Fuji Polymer Ind. Corp.), which is shaped so that it can hermetically cover the entire miniature microphone except for the terminal area and a sound-collecting portion and at the same time clamps and fixes the zebra-type rubber connector with anisotropic conductivity in areal contact with the terminal, can be used as a silicone rubber casting for protection against vibration.

When this rubber casting for protection against vibration is installed on the miniature microphone, the above rubber connector fits properly into the rubber casting on the terminal area side of the miniature microphone. Therefore, when the rubber connector is in areal contact with the terminal area of the miniature microphone, it is clamped and fixed by the resilient force of the rubber casting for protection against vibration. Thus, a miniature microphone component is obtained, wherein the miniature microphone, the rubber casting for protection against vibration covering the miniature microphone and the rubber connector are all integrated into one component.

To install the miniature microphone component, it is sufficient to insert the miniature microphone component into a small-size communication device so that the zebra-type rubber connector with anisotropic conductivity are pressed against the terminal portion on a circuit board. Thus, the working efficiency of the assembly can be increased considerably, the installation space can be minimized and an electrical connection with high reliability is possible.

Possible materials to be used for the rubber member of the zebra-type rubber connector with anisotropic conductivity include polybutadiene, natural rubber, polyisoprene, SBR, NBR, EPDM, EPM, polyurethane-polyester-based rubber, chloroprene rubber, epichlorohydrin rubber and silicone rubber. However, considering its isolating properties and weather resistance, silicone rubber is the most preferable.

Furthermore, it is preferable that the electrically conductive layer of the zebra-type rubber connector with anisotropic conductivity is made of electrically conductive rubber that comprises, per 100 weight parts rubber, 1–400 weight parts of at least one metal powder selected from the group consisting of platinum, gold, silver, nickel, cobalt, copper, tin, aluminum and palladium metal powder; an alloy powder containing solder; a conductive powder of organic polymer powder that has been coated with a metal; and a conductive powder of inorganic powder that has been coated with a metal; or that it is made of electrically conductive rubber that comprises 10–150 weight parts carbon powder per 100 weight parts rubber component.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A miniature microphone component, comprising:

a miniature microphone having a terminal area;

a rubber casting for protection against vibration covering a circumference of the miniature microphone;

a rubber connector with anisotropic conductivity comprising electrically conductive layers and electrically isolating layers, which is clamped and retained so as to have areal contact with the terminal area of the microphone, the rubber connector being clamped and fixed by the resilient force of the rubber casting; and wherein the miniature microphone, the rubber casting for protection against vibration covering the miniature microphone and the conductive rubber connector with anisotropic conductivity are integrated into one component.

2. The miniature microphone component according to claim 1, wherein the rubber connector with anisotropic conductivity is shaped so that none of its electrically conductive layers has contact with more than one terminal of the miniature microphone at a time.

3. The miniature microphone component according to claim 1, wherein the rubber casting for protection against vibration is made of silicone rubber.

4. The miniature microphone component according to claim 1, wherein the rubber connector with anisotropic conductivity comprises silicone rubber.

5. The miniature microphone component according to claim 1, wherein the electrically conductive layers of the rubber connector with anisotropic conductivity comprise, per 100 weight parts of rubber component, 1–400 weight parts of at least one powder selected from the group consisting of platinum, gold, silver, nickel, cobalt, copper, tin, aluminum and palladium metal powder; an alloy powder containing solder; a conductive powder of organic polymer powder that has been coated with a metal; and a conductive powder of inorganic powder that has been coated with a metal.

6. The miniature microphone component according to claim 1, wherein the electrically conductive layers of the rubber connector with anisotropic conductivity contain 10–150 weight parts carbon powder per 100 weight parts rubber component.

7. The miniature microphone component according to claim 1, wherein the rubber connector with anisotropic conductivity is elastically compressible and can be area-contacted with a terminal portion on a circuit board.

8. The miniature microphone component according to claim 1, wherein the rubber connector with anisotropic conductivity has a compression resilience of 30–80 measured with Method A in JIS K6301.

9. A small-size portable communication device comprising a miniature microphone component according to claim 1.

10. The small-size portable communication device according to claim 9, carried out as a mobile phone.

11. A miniature microphone component, comprising:

a microphone having a top surface, a bottom surface, a perimeter surface extending between the top and bottom surfaces, and a terminal area on at least one of the top or bottom surfaces;

a rubber connector with anisotropic conductivity comprising electrically conductive layers and electrically isolating layers, which is clamped and retained so as to have areal contact with the terminal area of the microphone;

a non-conductive rubber bushing surrounding the perimeter surface of the microphone, the rubber bushing including a flange that is disposed over and at least partially covers the top surface of the microphone, and a flange that is disposed over and at least partially covers the bottom surface of the microphone;

wherein the rubber connector is clamped and fixed by the resilient force of the rubber bushing.

* * * * *